United States Patent [19]

Hashimoto et al.

[11] Patent Number: 4,743,314

[45] Date of Patent: May 10, 1988

[54] HIGHLY CORROSIVE-RESISTANT AMORPHOUS ALLOY OF NI-CU-TI WITH TA AND/OR NB.

[75] Inventors: Koji Hashimoto, 2-25-5 Shogen, Izumi Miyagi; Kimikado Miura, Chiba; Katsuhiko Asami; Asahi Kawashima, both of Miyagi, all of Japan

[73] Assignees: Mitsui Engineering & Shipbuilding Co., Ltd., Tokyo; Koji Hashimoto, Miyagi, both of Japan

[21] Appl. No.: 99,371

[22] Filed: Sep. 21, 1987

[30] Foreign Application Priority Data

Sep. 24, 1986 [JP] Japan ..... 61-225677

[51] Int. Cl.[4] ..... C22C 19/03

[52] U.S. Cl. ..... 148/403; 420/487; 420/488; 420/587

[58] Field of Search ..... 148/403; 420/487, 488, 420/587

[56] References Cited

U.S. PATENT DOCUMENTS 4,565,589 1/1986 Harrison ..... 420/457

FOREIGN PATENT DOCUMENTS 0029086 12/1964 Japan ..... 420/488

*Primary Examiner*—Upendra Roy

*Attorney, Agent, or Firm*—Frank J. Jordan; C. Bruce Hamburg; Manabu Kanesaka

[57] ABSTRACT

A highly corrosion-resistant amorphous Ni-Cu-Ti-Ta, Ni-Cu-Ti-Nb and Ni-Cu-Ti-Ta-Nb alloys in which the sum of Ti and Ta and/or Nb is 30–62.5 atomic %.

1 Claim, 1 Drawing Sheet

HIGHLY CORROSIVE-RESISTANT AMORPHOUS ALLOY OF NI-CU-TI WITH TA AND/OR NB.

FIELD OF THE INVENTION AND RELATED ART STATEMENT

The present invention relates to a highly corrosion-resistant amorphous alloy which withstands severe corrosive environments such as concentrated hydrochloric acids.

Heretofore, there has been no metallic materials except for Ta metal which are corrosion resistant in concentrated hydrochloric acids.

In view of the above-foregoing, there has been a strong demand for a further new material which can be used in such severe environments.

SUMMARY OF THE INVENTION

It is an objective of the present invention to provide a highly corrosion-resistant amorphous alloy which withstands poorly oxidizing highly corrosive environments such as concentrated hydrochloric acids.

The objective of the invention is achieved by an amorphous alloy of specific composition containing Ta or Nb together with Ti, Ni and Cu as essential components.

According to the present invention, the following alloys are provided:

A highly corrosion-resistant amorphous alloy which consists of Ti, Ni and one or two elements selected from the group of Ta and Nb, with the balance being substantially Cu, wherein either 5 atomic% or more Ta or 15 atomic% or more Nb should be contained, the total content of Ti and said one or two elements from Ta and Nb being 30 to 62.5 atomic%, the content of Ni being 0.6–4 times of Ta and/or Nb and the content of Cu being 0.6–4 times of Ti.

DESCRIPTION OF THE PREFERRED EMBODIMENTS

Figure 1:
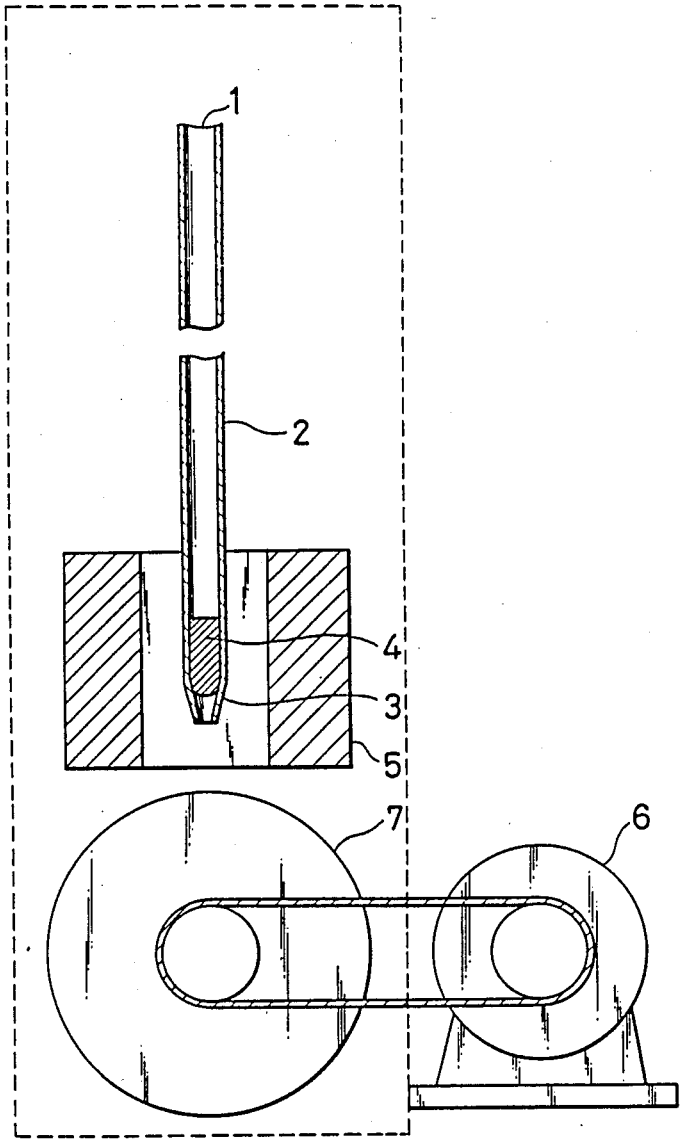
FIG. 1 shows an apparatus for preparing an alloy of the present invention.

Concentrated hydrochloric acid has a low oxidizing power and very high corrosiveness which readily break the protective passive film on metallic materials, and hence there are no metallic materials corrosion-resistant in concentrated hydrochloric acids. It is, therefore, eagerly expected to find metallic materials corrosion-resistant in such an environment.

The present invention aims to provide alloys corrosion-resistant in the poorly oxidizing very aggressive environment in which metallic materials are hardly passivated.

It is generally known that an alloy has a crystalline structure in the solid state. However, an alloy having a specific composition becomes amorphous by prevention of the formation of long-range order structure during solidification through, for example, rapid solidification from the liquid state, sputter deposition or plating under the specific conditions; or by destruction of the long-range order structure of the solid alloy through ion implantation which is also effective for supersaturation which necessary elements. The amorphous alloy thus formed is an extremely homogeneous solid solution containing sufficient amounts of various alloying elements beneficial in providing specific characteristics.

The present inventors carried out a series of researches paying their attention to the outstanding properties of amorphous alloys. They found amorphous alloys corrosion-resistant in boiling concentrated nitric acid which may contain oxidizing agent, and made Japanese patent application as Application No. 85-51036 consisting of the following four claims:

(1) A highly corrosion-resistant amorphous alloy which comprises 15 to 80 atomic% of Ta, with the balance being substantially Ni.

(2) A highly corrosion-resistant amorphous alloy which comprises Ta and one or more elements selected from the group consisting of Ti, Zr, Nb and W, with the balance being substantially Ni, wherein the content of Ta is 10 atomic% or more and the total content of Ta and said one or more elements selected from said group is 15 to 80 atomic%.

(3) A highly corrosion-resistant amorphous alloy which comprises Ta and Fe and/or Co, with the balance being substantially Ni, wherein the content of Ta is 15 to 80 atomic%, the content of Fe and/or Co is 75 atomic% or less, and the content of Ni is 7 atomic% or more.

(4) A highly corrosion-resistant amorphous alloy which comprises Ta, one or more elements selected from the group consisting of Ti, Zr, Nb, and W, and Fe and/or Co, with the balance being substantially Ni, wherein the content of Ta is 10 atomic% or more, the total content of Ta and said one or more elements selected from said group is 15 to 80 atomic%, the content of Fe and/or Co is 75 atomic% or less, and the content of Ni is 7 atomic% or more.

Furthermore the present inventors found amorphous alloys corrosion-resistant in very corrosive environments such as boiling concentrated hydrochloric acids and made Japanese patent application as the Application No 85-172860 and No. 85-172861. No. 85-172860 consists of the following 16 claims:

(1) A highly corrosion-resistant amorphous alloy which comprises 30 to 80 atomic% Ta, with the balance being substantially Ni.

(2) A highly corrosion-resistant amorphous alloy which comprises 12 atomic% or more Ta, 30 to 80 atomic% in total of Ta and Nb, with the balance being substantially Ni.

(3) A highly corrosion-resistant amorphous alloy which comprises 25 atomic% or more Ta, 30 to 80 atomic% in total of Ta and one or more elements selected from the group consisting of Ti, Zr, and Cr, with the balance being substantially Ni.

(4) A highly corrosion-resistant amorphous alloy which comprises 12 atomic% or more Ta, 25 atomic% or more in total of Ta and Nb, 30 to 80 atomic% in total of Ta, Nb, and one or more elements selected from the group consisting of Ti, Zr, and Cr, with the balance being substantially Ni.

(5) A highly corrosion-resistant amorphous alloy which comprises 30 to 80 atomic% of Ta, and 2 atomic% or more Ni, with the balance being substantially either or both of Fe and Co, and the total amount being 100 atomic%.

(6) A highly corrosion-resistant amorphous alloy which comprises 12 atomic% or more Ta, 30 to 80 atomic% in total of Ta and Nb and 2 atomic% or more Ni, with the balance being substantially either or both of Fe and Co, and the total amount being 100 atomic%.

(7) A highly corrosion-resistant amorphous alloy which comprises 25 atomic% or more Ta, 30 to 80 atomic% in total of Ta and one or more elements selected from the group consisting of Ti, Zr, and Cr, 2 atomic% or more Ni, with the balance being substantially either or both of Fe and Co, and the total amount being 100 atomic%.

(8) A highly corrosion-resistant amorphous alloy which comprises 12 atomic% or more Ta, 25 atomic% in total of Ta and Nb, 30 to 80 atomic% in total of Ta, Nb, and one or more elements selected from the group consisting of Ti, Zr, and Cr, 2 atomic% or more Ni, with the balance being substantially either or both of Fe and Co, and the total amount being 100 atomic%.

(9) A highly corrosion-resistant amorphous alloy which comprises 20 atomic% or more but less than 80 atomic% of Ta, and 7 atomic% or less P, and 20 atomic% or more Ni and the total amount being 100 atomic%.

(10) A highly corrosion-resistant amorphous alloy which comprises 7 atomic% or more Ta, 20 atomic% or more but less than 80 atomic% in total of Ta and Nb, and 7 atomic% or less P, with the balance being substantially and 20 atomic% or more Ni and the total amount being 100 atomic%.

(11) A highly corrosion-resistant amorphous alloy which comprises 15 atomic% or more Ta, 20 atomic% or more but less than 80 atomic% in total of Ta and one or more elements selected from the group consisting of Ti, Zr, and Cr, and 7 atomic% or less P, with the balance being substantially and 20 atomic% or more Ni and the total amount being 100 atomic%.

(12) A highly corrosion-resistant amorphous alloy which comprises 7 atomic% or more Ta, 16 atomic% or more in total of Ta and Nb, 20 atomic% or more but less than 80 atomic% in total of Ta, Nb, and one or more elements selected from the group consisting of Ti, Zr, and Cr, and 7 atomic% or less P, with the balance being substantially 20 atomic% or more Ni and the total amount being 100 atomic%.

(13) A highly corrosion-resistant amorphous alloy which comprises 20 atomic% or more but less than 80 atomic% in total of Ta, Nb, 2 atomic% or more Ni, and 7 atomic% or less P, and 20 atomic% or more in total of Ni and either or both of Fe and Co which are substantially the balance, with the total amount being 100 atomic%.

(14) A highly corrosion-resistant amorphous alloy which comprises 7 atomic% or more Ta, 20 atomic% or more but less than 80 atomic% in total of Ta and Nb, 2 atomic% or more Ni, and 7 atomic% or less P, and 20 atomic% or more in total of Ni and either or both of Fe and Co which are substantially the balance, with the total amount being 100 atomic%.

(15) A highly corrosion-resistant amorphous alloy which comprises 15 atomic% or more Ta, 20 atomic% or more but less than 80 atomic% in total of Ta and one or more elements selected from the group consisting of Ti, Zr, and Cr, 2 atomic% or more Ni, and 7 atomic% or less P, and 20 atomic% or more in total of Ni and either or both of Fe and Co which are substantially the balance, with the total amount being 100 atomic%.

(16) A highly corrosion-resistant amorphous alloy which comprises 7 atomic% or more Ta, 16 atomic% or more in total of Ta and Nb, 20 atomic% or more but less than 80 atomic% in total of Ta, Nb, and one or more elements selected from the group consisting of Ti, Zr, and Cr, 2 atomic% or more Ni, and 7 atomic% or less P, and 20 atomic% or more in total of Ni and either or both of Fe and Co which are substantially the balance, with the total amount being 100 atomic%.

No. 85-172861 is composed of the following 16 claims:

(1) A highly corrosion-resistant amorphous alloy which comprises 20 to 50 atomic% of Ta and 10 to 23 atomic% of P, with the balance being substantially Ni.

(2) A highly corrosion-resistant amorphous alloy which comprises 7 atomic% or more Ta, 20 to 50 atomic% in total of Ta and Nb, and 10 to 23 atomic% of P, with the balance being substantially Ni.

(3) A highly corrosion-resistant amorphous alloy which comprises 15 atomic% or more Ta, 20 to 50 atomic% in total of Ta and one or more elements selected from the group consisting of Ti, Zr, and Cr, and 10 to 23 atomic% of P, with the balance being substantially Ni.

(4) A highly corrosion-resistant amorphous alloy which comprises 8 atomic% or more Ta, 16 atomic% or more in total of Ta and Nb, 20 to 50 atomic% in total of Ta, Nb, and one or more elements selected from the group consisting of Ti, Zr, and Cr, and 10 to 23 atomic% of P, with the balance being substantially Ni.

(5) A highly corrosion-resistant amorphous alloy which comprises 20 to 50 atomic% of Ta, 10 to 23 atomic% of P, and 2 atomic% or more Ni, with the balance being substantially either or both of Fe and Co, and the total amount being 100 atomic%.

(6) A highly corrosion-resistant amorphous alloy which comprises 7 atomic% or more Ta, 20 to 50 atomic% in total of Ta and Nb, 10 to 23 atomic% of P, and 2 atomic% or more Ni, with the balance being substantially either or both of Fe and Co, and the total amount being 100 atomic%.

(7) A highly corrosion-resistant amorphous alloy which comprises 15 atomic% or more Ta, 20 to 50 atomic% in total of Ta and one or more elements selected from the group consisting of Ti, Zr, and Cr, 10 to 23 atomic% of P, and 2 atomic% or more Ni, with the balance being substantially either or both of Fe and Co, and the total amount being 100 atomic%.

(8) A highly corrosion-resistant amorphous alloy which comprises 8 atomic% or more Ta, 16 atomic% or more in total of Ta and Nb, 20 to 50 atomic% in total of Ta, Nb, and one or more elements selected from the group consisting of Ti, Zr, and Cr, 10 to 23 atomic% of P, and 2 atomic% or more Ni, with the balance being substantially either or both of Fe and Co, and the total amount being 100 atomic%.

(9) A highly corrosion-resistant amorphous alloy which comprises 20 to 50 atomic% of Ta, 0.05 atomic% or more P, and 10 to 23 atomic% in total of P and one or more elements selected from the group consisting of B, Si, and C, with the balance being substantially Ni.

(10) A highly corrosion-resistant amorphous alloy which comprises 7 atomic% or more Ta, 0.05 atomic% or more P, 20 to 50 atomic% in total of Ta and Nb, and 10 to 23 atomic% in total of p and one or more elements selected from the group consisting of B, Si, and C, with the balance being substantially Ni.

(11) A highly corrosion-resistant amorphous alloy which comprises 15 atomic% or more Ta, 0.05 atomic% or more P, 20 to 50 atomic% in total of Ta and one or more elements selected from the group consisting of Ti, Zr, and Cr, and 10 to 23 atomic% in total of P and one or more elements selected from the group consisting of B, Si, and with the balance being substantially Ni.

(12) A highly corrosion-resistant amorphous alloy which comprises 8 atomic% or more Ta, 0.05 atomic% or more P, 16 atomic% or more in total of Ta and Nb, 20 to 50 atomic% in total of Ta, Nb, and one or more elements selected from the group consisting of Ti, Zr, and Cr, and 10 to 23 atomic% in total of P and one or more elements selected from the group consisting of B, Si, and C, with the balance being substantially Ni.

(13) A highly corrosion-resistant amorphous alloy which comprises 20 to 50 atomic% of Ta, 0.05 atomic% or more P, 2 atomic or more Ni, and 10 to 23 atomic in total of P and on or more elements selected from group consisting of B, Si, and C, with the balance being substantially either or both of Fe and Co, and the total amount being 100 atomic%.

(14) A highly corrosion-resistant amorphous alloy which comprises 7 atomic% or more Ta, 0.05 atomic% or more P, 2 atomic% or more Ni, 20 to 50 atomic% in total of Ta and Nb, and 10 to 23 atomic% in total of P and one or more elements selected from the group consisting of B, Si, and C, with the balance being substantially either or both of Fe and Co, and the total amount being 100 atomic%.

(15) A highly corrosion-resistant amorphous alloy which comprises 15 atomic% or more Ta, 0.05 atomic% or more P, 2 atomic% or more Ni, 20 to 50 atomic% in total of Ta and one or more elements selected from the group consisting of Ti, Zr, and Cr, and 10 to 23 atomic% in total of P and one or more elements selected from the group consisting of B, Si, and C, with the balance being substantially either or both of Fe and Co, and the total amount being 100 atomic%.

(16) A highly corrosion-resistant amorphous alloy which comprises 8 atomic% or more Ta, 0.05 atomic% or more P, 2 atomic% or more Ni, 16 atomic% or more in total of Ta and Nb, 20 to 50 atomic% in total of Ta, Nb, and one or more elements selected from the group consisting of Ti, Zr, and Cr, and 10 to 23 atomic% in total of P and one or more elements selected from the group consisting of B, Si, and C, with the balance being substantially either or both of Fe and Co, and the total amount being 100 atomic%.

The present inventors further carried out investigations paying attention to the characteristics of amorphous alloys. As the result they found that other than the alloys described in Japanese Patent Application Nos. 85-51036, 85-172860 and 85-172861 there are amorphous alloys having a high corrosion resistance in a poorly oxidizing aggressive acid such as a concentrated hydrochloric acid due to the formation of a stable passive film. These findings led to the present invention which covers the alloys set forth in the Claim.

Table 1 shows the components and compositions of the alloys set forth in the Claim.

TABLE 1

| Ti, Ta, Nb (*1) | Ni | (atomic %) Cu (*2) |
|---|---|---|
| 30–62.5 | 0.6–4 times of Ta and/or Nb | 0.6–4 times of Ti |

(*1) The sum of Ti and one or two elements selected from the group of Ta and Nb, but either 5 atomic % or more Ta or 15 atomic % or more Nb should be contained.
(*2) Substantially Cu The amorphous alloys of this invention are produced by commonly used methods for production of amorphous alloys such as rapid solidification from the liquid state or sputter deposition. They are single-phase alloys in which the alloying elements exist in a state of uniform solid solution. Accordingly, they form an extremely uniform and highly corrosion-resistant protective passive film in a poorly oxidizing environment.

Metallic materials are readily dissolved in a poor oxidizing very aggresssive hydrochloric acid. Therefore, those metallic materials intended for use in such an environment should have an ability to form a stable protective passive film. This objective is achieved by an alloy containing effective elements as much as necessary. However, it is not desirable to add various alloying elements in large quantities to a crystalline metal, because the resulting alloy is of a multiple phase mixture, with each phase having different chemical properties, and is not so satisfactory in corrosion resistance as intended. Moreover, the chemical heterogeneity is rather harmful to corrosion resistance.

By contrast, the amorphous alloys of this invention are of homogeneous solid solution. Therefore, they homogeneously contain effective elements as much as required to form uniformly a stable passive film. Owing to this uniform passive film, the amorphous alloys of this invention exhibit sufficiently high corrosion resistance.

In other words, metallic materials to withstand a poor oxidizing concentrated hydrochloric acid should form a uniform, stable passive film in such an environment. Alloys of amorphous structure permit many alloying elements to exist in a form of single-phase solid solution, and also permit the formation of a uniform passive film.

The components and compositions of the alloys of this invention are specified as above for the following reasons:

Ta, Nb and Ti are able to form a protective passive film in a poor oxidizing acid and contribute to the corrosion resistance. Among them Ta has the highest ability to form the passive film, and hence if 5 atomic% or more Ta is contained the alloys in which the sum of Ta and Ti or Ta, Nb and Ti is 30 atomic% possess the sufficiently high corrosion resistance in a concentrated hydrochloric acid due to the formation of the protective passive film. The passivating ability of Nb is the second highest among Nb, Ta and Ti, and the alloys in which the sum of Ti and 15 atomic% or more Nb is 30 atomic% have the sufficiently high corrosion resistance.

Ni and Cu are able to form the amorphous structure when they coexist with one or more of elements selected from the group of Ta, Nb and Ti. In particular, Ni is able to form the amorphous structure being alloyed with Ta and/or Nb, and Cu easily forms the amorphous structure when Ti is alloyed. Accordingly in alloys consisting of Ti, Ni, Cu and one or two elements of Ta and Nb, the content of Ni is 0.6–4 times of Ta and/or Nb, and the content of Cu which is substantially balance of the alloys is 0.6–4 times of Ti. Therefore the sum of Ti and one or two elements selected from the group of Ta and Nb is 62.5 atomic% or less.

The amorphous alloys set forth in the Claim may contain 5 atomic% or less Mo, W and Zr without any adverse effect on the objective of this invention.

The amorphous alloys of this invention form a stable passive film and are immune to corrosion in severe corrosive environments such as concentrated hydrochloric acids.

The amorphous alloys of this invention can be produced by using any of the existing methods for the production of amorphous alloys such as rapid solidification of molten alloys, formation of of amorphous structure through gas phase, and ion implantation that destroys the long-range order of the solid. Therefore, they can be produced with the existing apparatus, and consequently they are of practical value.

One embodiment of apparatus for preparing the amorphous alloys of the present invention is shown in FIG. 1. The apparatus is placed in a vacuum chamber indicated by a dotted rectangle. In the figure, a quartz tube (2) has nozzle (3) at its lower end in the vertical direction, and raw materials (4) and an inert gas for a jet of the raw materials melted are fed from the inlet (1). A heater (5) is placed around the quartz tube (2) so as to heat the raw materials (4). A high speed wheel (7) is placed below the nozzle (3) and is rotated by a motor (6).

The apparatus is previously evacuated up to about $10^{-5}$ torr and then exposed to an inert gas atmosphere such as argon or nitrogen. The raw materials (4) having the specific compositions required are melted by the heater (5) in the quartz tube under an inert gas atmosphere. The molten alloys impinge under the pressure of the inert gas on to the outer surface of the wheel (7) which is rotated at a speed of 1,000 to 10,000 rpm whereby the amorphous alloys are formed as long thin plates, which may for example have thickness of 0.1 mm, width of 10 mm and length of several tens of meters.

The invention is now illustrated by the following example:

EXAMPLE

A variety of alloy ingots were cast by argon arc melting of commercial metals. The cast alloys were remelted in an argon atmosphere and the molten alloys were rapidly solidified by the rotating wheel method shown in FIG. 1 to form ribbon-shaped amorphous alloys 0.01–0.05 mm thick, 1–3 mm wide, and 3–20 m long. The nominal compositions of the alloys are given in Table 2.

TABLE 2

| | compositions of alloys | | | | (atomic %) |
|---|---|---|---|---|---|
| Specimen No. | Ti | Ta | Nb | Ni | Cu |
| 1 | 25 | 5 | | 3 | 67 |
| 2 | 25 | 5 | | 20 | 50 |
| 3 | 38 | 5 | | 5 | 52 |
| 4 | 15 | 10 | | 20 | 55 |
| 5 | 15 | 10 | | 35 | 40 |
| 6 | 34 | 10 | | 10 | 46 |
| 7 | 15 | 15 | | 12 | 58 |
| 8 | 34 | 15 | | 15 | 36 |
| 9 | 47 | 15 | | 15 | 28 |
| 10 | 19 | 20 | | 63 | 7 |
| 11 | 10 | 20 | | 35 | 35 |
| 12 | 15 | 20 | | 30 | 35 |
| 13 | 20 | 20 | | 20 | 40 |
| 14 | 30 | 20 | | 20 | 30 |
| 15 | 10 | 30 | | 30 | 30 |
| 16 | 15 | 30 | | 30 | 25 |
| 17 | 17 | 30 | | 30 | 23 |
| 18 | 10 | 40 | | 40 | 10 |
| 19 | 15 | | 15 | 15 | 55 |
| 20 | 15 | | 15 | 55 | 15 |

TABLE 2-continued

| | compositions of alloys | | | | (atomic %) |
|---|---|---|---|---|---|
| Specimen No. | Ti | Ta | Nb | Ni | Cu |
| 21 | 15 | | 16 | 10 | 59 |
| 22 | 40 | | 15 | 20 | 25 |
| 23 | 20 | | 20 | 30 | 30 |
| 24 | 15 | | 25 | 25 | 35 |
| 25 | 30 | 5 | 2 | 25 | 38 |
| 26 | 30 | 1 | 15 | 20 | 34 |

The formation of the amorphous structure was confirmed by X-ray diffractometry. The alloy specimens were polished with silicon carbide paper up to No. 1000 in cyclohexane. The alloy specimens were cut in the prescribed length of several tens of centimeters. Polarization curves of the specimens were measured in 1N HCl and 6N HCl at 30° C. They are spontaneously passive in these solutions. This indicates that these amorphous alloys possess a sufficiently high corrosion resistance.

The results obtained are shown in Table 3.

TABLE 3

| | State of the alloys in HCl | |
|---|---|---|
| Specimen No. | 1 N HCl 30° C. | 6 N HCl 30° C. |
| 1 | Spontaneously passive | Active state |
| 2 | Spontaneously passive | Active state |
| 3 | Spontaneously passive | Active state |
| 4 | Spontaneously passive | Spontaneously passive |
| 5 | Spontaneously passive | Spontaneously passive |
| 6 | Spontaneously passive | Spontaneously passive |
| 7 | Spontaneously passive | Spontaneously passive |
| 8 | Spontaneously passive | Spontaneously passive |
| 9 | Spontaneously passive | Spontaneously passive |
| 10 | Spontaneously passive | Spontaneously passive |
| 11 | Spontaneously passive | Spontaneously passive |
| 12 | Spontaneously passive | Spontaneously passive |
| 13 | Spontaneously passive | Spontaneously passive |
| 14 | Spontaneously passive | Spontaneously passive |
| 15 | Spontaneously passive | Spontaneously passive |
| 16 | Spontaneously passive | Spontaneously passive |
| 17 | Spontaneously passive | Spontaneously passive |
| 18 | Spontaneously passive | Spontaneously passive |
| 19 | Spontaneously passive | Active state |
| 20 | Spontaneously passive | Active state |
| 21 | Spontaneously passive | Spontaneously passive |
| 22 | Spontaneously passive | Spontaneously passive |
| 23 | Spontaneously passive | Spontaneously passive |
| 24 | Spontaneously passive | Spontaneously passive |
| 25 | Spontaneously passive | Active state |
| 26 | Spontaneously passive | Active state |

The above-mentioned amorphous alloys become spontaneously passivated in 1N HCl, forming a protective passive film, and the most of alloys are spontaneously passive in 6N HCl. Accordingly these alloys possess a high corrosion resistance. Protective passive films consisting of oxyhydroxides of Ta, Nb and Ti are formed on these alloys, and the formation of these passive films is responsible for the high corrosion resistance of the alloys of this invention.

What is claimed is:

1. A highly corrosion-resistant amorphous alloy which consists of Ti, Ni and one or two elements selected from the group of Ta and Nb, with the balance being substantially Cu, wherein either 5 atomic% or more Ta or 15 atomic% or more Nb should be contained, the total content of Ti and said one or two elements from Ta and Nb being 30 to 62.5 atomic%, the content of Ni being 0.6–4 times of Ta and/or Nb and the content of Cu being 0.6–4 times of Ti.

* * * * *